United States Patent [19]

Krueger

[11] 4,118,799

[45] Oct. 3, 1978

[54] APPARATUS FOR TRANSFERRING METERED QUANTITIES OF MATERIAL FROM ONE LOCATION TO ANOTHER

[76] Inventor: Wallace F. Krueger, 4401 Merriweather Rd., Toledo, Ohio 43623

[21] Appl. No.: 815,527

[22] Filed: Jul. 14, 1977

Related U.S. Application Data

[63] Continuation of Ser. No. 670,137, Mar. 25, 1976, abandoned.

[51] Int. Cl.[2] ..... G05D 11/00

[52] U.S. Cl. ..... 366/161; 366/162

[58] Field of Search ..... 366/160, 161, 162, 131; 417/343, 533, 539, 543, 555, 529, 900; 92/76, 162, 181

[56] References Cited

U.S. PATENT DOCUMENTS

| | | | |
|---|---|---|---|
| 110,177 | 12/1870 | Ward | 92/162 |
| 202,178 | 4/1878 | Laney | 417/533 |
| 268,676 | 12/1882 | Hopkins | 417/533 |
| 277,919 | 5/1883 | Newburgh | 417/555 |
| 291,859 | 1/1884 | Crawford | 417/533 X |
| 543,954 | 8/1895 | Wistrand | 417/529 X |
| 1,611,703 | 12/1926 | Zabriskie | 417/539 X |
| 2,142,062 | 12/1938 | Thurman | 366/161 |
| 3,123,342 | 3/1964 | Little | 366/162 |
| 3,289,607 | 12/1966 | Delligatti | 417/900 X |
| 3,684,250 | 8/1972 | Roeser | 366/161 |

*Primary Examiner*—Robert W. Jenkins
*Attorney, Agent, or Firm*—Allen D. Gutchess, Jr.

[57] ABSTRACT

Apparatus is provided for moving controlled quantities of a material from one location to another and increasing the pressure thereof. The apparatus includes at least two cylinders having rams reciprocable therein. The rams are driven by a rocker arm which is pivotally connected to outer ends of both rams and is pivotally supported at a position therebetween. The arm is driven through a fluid-operated cylinder having a piston rod connected to one end of the arm, thereby reciprocating the rams in opposite directions. The ram cylinders have inlets connected to a source of the material under low pressure with a ball check valve located between the source and each inlet. Outlets of these cylinders are connected to a common outlet with a ball check valve also located between the common outlet and each cylinder outlet. The valves are arranged so that the inlet check valves and the outlet check valves operate in opposing relationship to provide positive opening and closing action and a precise flow of material. The cylinders and rams are also designed to require minimum maintenance in the nature of cleaning and repair.

15 Claims, 4 Drawing Figures

APPARATUS FOR TRANSFERRING METERED QUANTITIES OF MATERIAL FROM ONE LOCATION TO ANOTHER

This is a continuation of application Ser. No. 670,137 filed Mar. 25, 1976, now abandoned.

This invention relates to apparatus for pumping metered quantities of materials from one location to another while raising the pressure thereof.

While the apparatus according to the invention is particularly advantageous for moving precise quantities of highly viscous materials, it is also effective for low viscosity materials, as long as the outlet pressure exceeds the inlet pressure. The apparatus employs substantially maintenance-free self-cleaning check valves and only two seals, one for each of two cylinders, are required for the overall system. The cylinders are also designed to be substantially self-cleaning to prevent the build-up of the material in portions of the system and subsequent possible clogging or jamming thereof, as has heretofore commonly occurred with systems which pump and meter highly viscous materials. The apparatus is capable of not only pumping precise quantities, but can be readily regulated to change the quantities. The apparatus can also pump two or more materials in a precise volumetric ratio.

More specifically, the apparatus according to the invention includes at least one pair of cylinders in which rams are located, with drive means for reciprocating the rams in opposite directions in the cylinders. A source of material under low pressure communicates with inlets at the blind ends of the cylinders through inlet lines, each of which has a ball check valve for enabling the flow of the material only toward the respective cylinder. A common outlet communicates with outlets at the opposite ends of the cylinders through outlet lines, each of which also has a ball check valve enabling flow of the material only away from the respective cylinder. The ball check valves are arranged so as to be power operated, in effect, by the inlet and outlet pressures, as will be discussed subsequently in detail. The valves also act with a quick, positive action to provide accurate quantities of the material through each of the cylinders.

The rams of the cylinders are reciprocated in opposite directions by means of a rocker arm which is pivotally connected to the rams and is pivotally supported at a point therebetween. The rocker arm can be oscillated or rocked through a fluid-operated cylinder which is connected to an outer end of the rocker arm and suitably powered by a source of fluid under pressure. In a preferred form, the pivotal engagement of the rocker arm with the rams can be changed relative to the pivotal support, thereby changing the length of stroke of the rams and, consequently, the quantities of material being pumped. If desired, a second material can be pumped through a second pair of cylinders and rams which are also mounted on the rocker arm in predetermined positions relative to the pivot support and to the pivotal engagements with the first rams. A precise ratio of the second material to the first one can then be achieved and maintained. Of course, more than two pairs of cylinders and rams can be employed if the need arises for additional material.

It is, therefore, a principal object of the invention to provide apparatus for moving precise quantities of material from one location to another and for raising the pressure thereof.

Another object of the invention is to provide apparatus for pumping viscous materials, which apparatus is more maintenance free, requiring less cleaning and repair, than heretofore.

Yet another object of the invention is to provide an improved valve system for pumping and metering material by the use of cylinders and rams.

A further object of the invention is to provide apparatus for pumping materials, which apparatus includes at least a pair of cylinders with rams reciprocably driven by a rocker arm pivoted therebetween.

Other objects and advantages of the invention will be apparent from the following detailed description of preferred embodiments thereof, reference being made to the accompanying drawings, in which.

The apparatus according to the invention is particularly designed to pump and meter highly viscous materials, such as viscous resins that are also heavily loaded with fillers, such as calcium carbonate, aluminum hydrate, or glass-reinforcing fibers. Further, the apparatus requires minimal maintenance. Only two seals which are subject to wear are employed for the overall system and the flow of the viscous material through the system is designed to render the system substantially self-cleaning. Consequently, frequent repairs and cleaning are not necessary.

Figure 1:
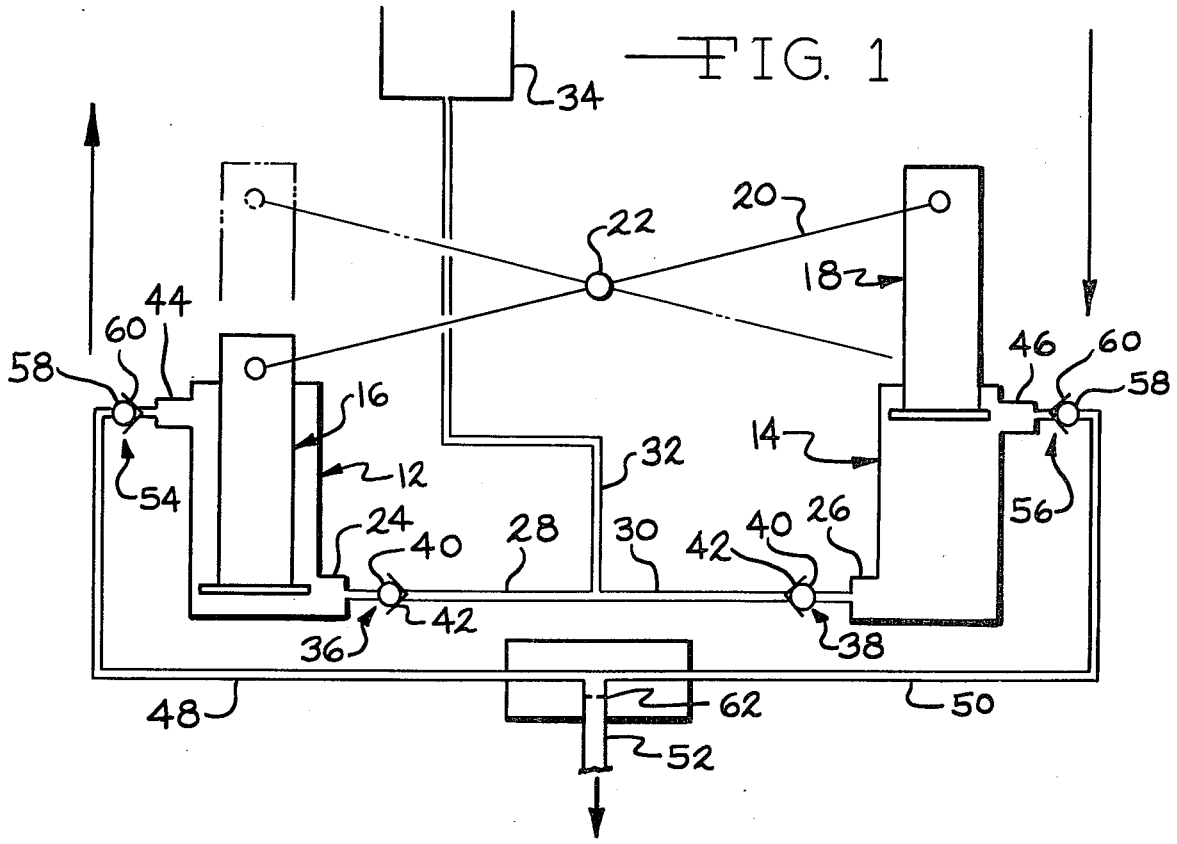
FIG. 1 is a diagrammmatic view of apparatus for moving or transferring quantities of material from one location to another in accordance with the invention.

Referring to FIG. 1, apparatus according to the invention includes two cylinders 12 and 14 in which are reciprocated rams 16 and 18. The rams are reciprocated in the cylinders by a lever or rocker arm 20 which is centrally pivotally supported by a pin 22 at equal distances from the rams. Consequently, the rams 16 and 18 reciprocate through equal strokes in opposite directions.

The cylinders 12 and 14 have inlets 24 and 26 at the blind ends thereof. These inlets are connected by inlet lines 28 and 30 and a common inlet supply line 32 to a suitable source 34 of a material to be transferred and metered. The material of the source 34 is maintained under low pressure. In this instance, the pressure is achieved by virtue of the supply source 34 being positioned above the cylinders 12 and 14. Otherwise, the material can be maintained in a closed supply container under pressure or can be pumped at low pressure through the inlet supply line 32 to the supply lines 28 and 30. The inlet lines 28 and 30 contain ball check valves 36 and 38, each of which includes a ball 40 and a seat 42, to permit flow only toward the cylinders. The balls can be spring loaded, if desired, although this is not necessary.

The cylinders 12 and 14 also have outlets 44 and 46 to which outlet lines 48 and 50 are connected. The outlet lines 48 and 50 communicate with a common outlet 52 which can direct the metered, higher pressure material to any suitable location. Ball check valves 54 and 56 are located in the outlet lines 48 and 50 to direct the material in the lines 48 and 50 only away from the cylinders 12 and 14. Each of the ball check valves 54 and 56 has a ball 58 and a seat 60.

The pressure of the material in the outlet line 52 must exceed that in the inlet supply line 32 or the flow of the material through the cylinders 12 and 14 will be inaccurate and, in fact, flow through the cylinders can occur without reciprocation of the rams 16 and 18 at all. In some instances, to assure sufficient pressure in the outlet line 52 and the lines 48 and 50, back pressure means such as an orifice 62 or a back pressure valve can be provided in the line 52.

The operation of the systems of FIG. 1 will now be discussed in more detail. Assuming that the ram 16 is moving upwardly, as indicated by the arrow, the viscous material will be drawn through the inlet line 28 past the check valve 36 from the source 34. During this movement, the pressure in the inlet line 30 for the cylinder 14 will tend to be lowered and, therefore, the check valve 38 will tend to be urged even more completely closed. At the same time, the ram 18 is moving downwardly, as indicated by the arrow, to force the material out of the cylinder 14 and past the check valve 56. This material will flow through the outlet line 50 and, since this communicates with the outlet line 48, the pressure therein will increase to tend to more completely close the check valve 54 for the outlet of the cylinder 12.

From the above, it will be seen that the check valves are powered, in effect, by virtue of the pressures in the system. This assures accurate and precise opening and closing of the check valves to aid in assuring that precise, metered quantities of the materials will be moved to the common outlet 52 from the source 34. The precision of the metering rams is enhanced due to the quick, positive action of the check valves at the precise time of cycle reversal. This is particularly important when viscous resins with high loadings of abrasive fillers are being pumped since quick and responsive valve action is particularly needed in those instances. By using this pressure to power operate the check valves, separate power arrangements, such as involving separate air, oil, or mechanically powered valves with the necessary circuitry, can be eliminated completely. The simplified piping involved also eliminates additional heat loads that may otherwise be incurred with alternate powered valve systems. With the viscous materials in particular, heat generation should be kept to a minimum in order to extend the life of the seals employed and to prevent premature catalytic reaction when materials subject to such are being pumped.

Figure 2:
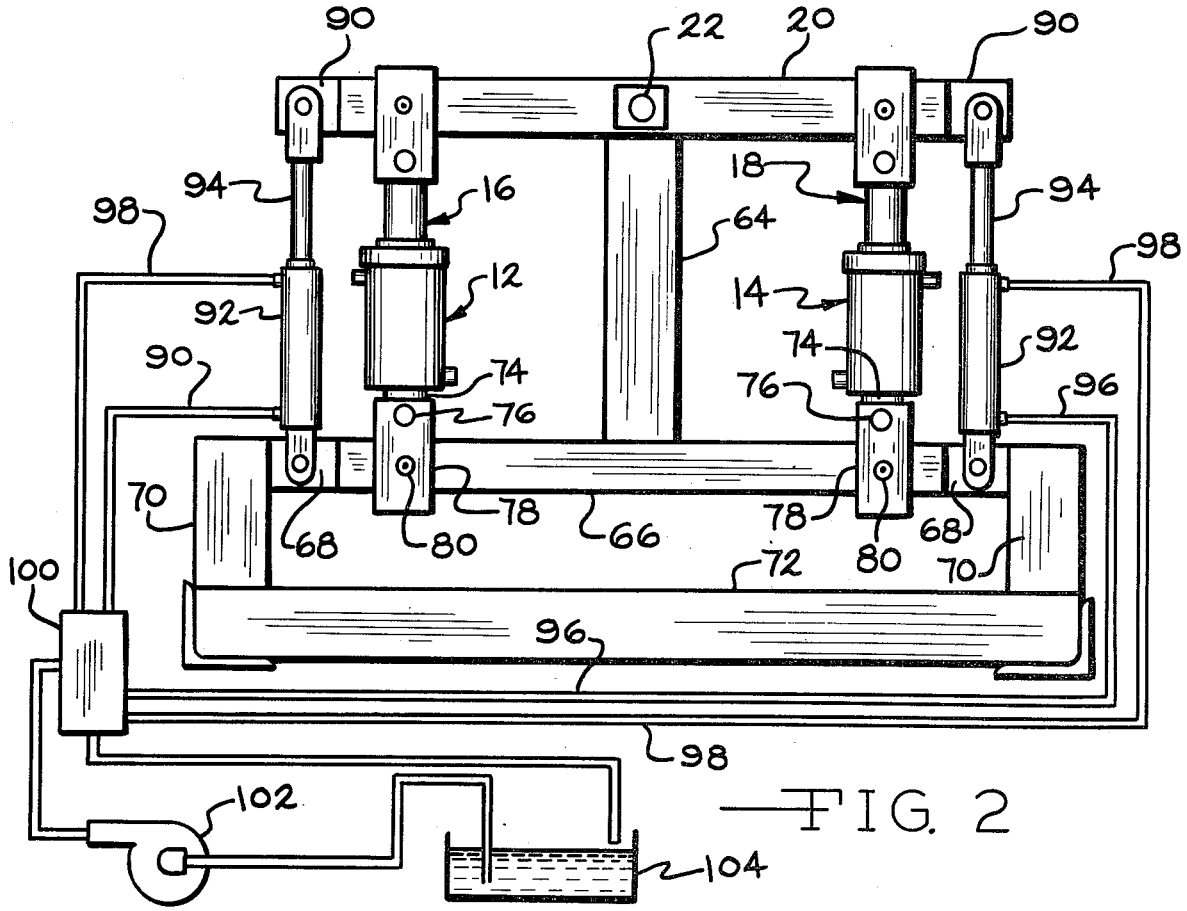
FIG. 2 is a schematic view in elevation of certain components shown in FIG. 1, with additional components also shown.
Figure 3:
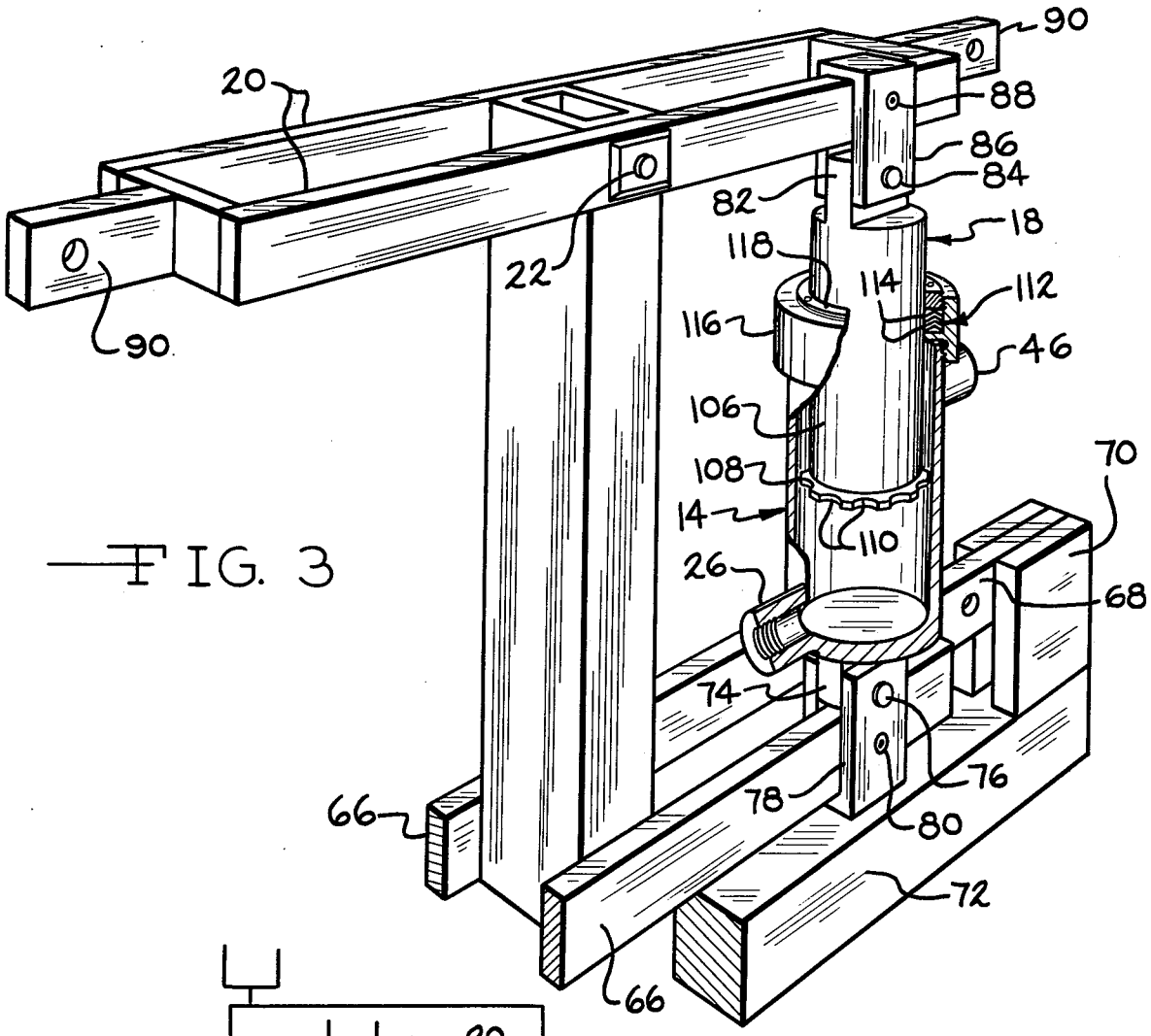
FIG. 3 is a fragmentary view in perspective, with parts broken away and with parts in cross section, of certain components of FIG. 2.

The rocker arm 20 for reciprocating the rams 16 and 18 in opposite directions is shown in somewhat more detail in FIGS. 2 and 3. The rocker arm is pivotally supported by the pivot pin 22 on a central supporting post 64 which is affixed to and extends upwardly from a base frame member 66. Actually, as shown in FIG. 3, two of the rocker arms 20 and the base members 66 can be employed. The latter are connected through end extensions 68 to vertical supporting blocks 70 extending upwardly from a base beam 72.

The lower ends of the cylinders 12 and 14 have ears 74 which are pivotally attached to the base member 66 by pins 76 which extend through the ears 74 and legs of lower yokes 78. The yokes 78, in turn, are adjustably affixed at the desired positions longitudinally of the base member 66 by suitable fasteners in the form of setscrews or bolts 80.

Similarly, the upper ends of the rams 16 and 18 have ears 82 which are pivotally connected to the rocker arm 20 by pins 84 extending through the ears 82 and through legs of upper yokes 86. The upper yokes 86 are similarly adjustable along the rocker arm 20 and affixed in desired positions by fasteners in the form of setscrews or bolts 88.

The strokes of the rams 16 and 18 can be readily changed by moving the cylinders and rams toward and away from the supporting post 64. With the rams spaced equally from the supporting post 64, their strokes will always be equal and will be in opposite directions.

The rams can be reciprocated continuously or one stroke at a time, depending upon the output desired. To reciprocate the rams 16 and 18, the rocker arm 20 is rocked back and forth through equal arcs about the pivot pin 22. The rocker arm 20 can have extensions 90 with fluid-operated cylinders 92 and piston rods 94 pivotally connected between the extensions 68 and 90. Of course, one of the fluid-operated cylinders may be sufficient in some or most applications but the two are particularly advantageous for themore viscous materials to be handled. The cylinders can be supplied with fluid under pressure by any suitable means such as by lines 96 and 98 connected to a control valve 100. The fluid is supplied to the valve 100 from a pump 102 and a reservoir 104 or by various other suitable fluid systems. To change the outputs of the cylinders, the speed of cycling of the rocker arm can be varied which can be readily accomplished by volume control of the fluid-operated drive.

The cylinders and the rams will be discussed in more detail with reference being made to FIG. 3. By providing the inlet 26 at the low or blind end of the cylinder 14 and the outlet 46 at the upper or opposite end, the flow through the cylinder is more effective in preventing the material from tending to settle or accumulate in "dead spots." Particularly when resins with fillers are employed, the fillers have a tendency to settle and can jam or clog the system and require frequency cleaning. With the flow through the cylinder and past the ram, piston rings or similar seals are not needed. Rather, the ram 18 includes a main cylindrical portion 106 and an enlarged head 108 having openings or notches 110 therein. The enlarged head 108 can maintain the ram 18 in alignment in the cylinder 14 and yet the openings 110 enable the viscous material in the cylinder to flow past the head 108 and to the outlet 46 when the ram 18 is moving downwardly.

With this arrangement, the only seal required for the cylinder 14 is a seal 112 around the cylindrical portion 106 of the ram 18 at the upper end of the cylinder. The seal, as shown, includes a plurality of chevron-shaped packing glands 114 held in an annular recess of a packing ring 116 by a packing gland nut 118. This particular design enables the packing glands 114 to be replaced by removing the packing gland nut 118 with a spanner wrench after the yoke 86 is removed from the ear 82. The glands 114 can then be replaced without the necessity of removing the ram 18 from the cylinder 14 at all. The small number of resilient seals for the apparatus and the ease in replacement are particularly important when materials having abrasive characteristics, such as heavily filled resin mixes, are being handled.

Figure 4:
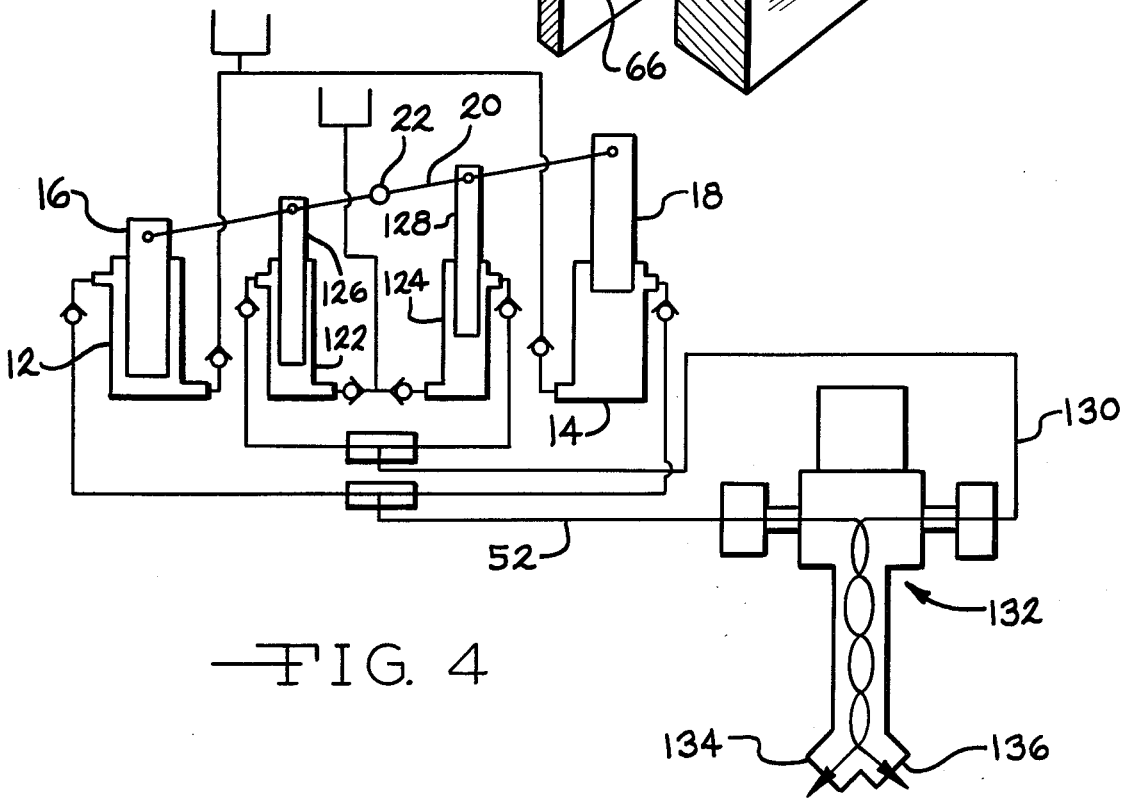
FIG. 4 is a diagrammatic view of the apparatus of FIG. 1 modified by the addition of more components and mixing means for two materials.

A specific application for the transfer metering system or apparatus embodying the invention is shown in FIG. 4, by way of further illustration. In this instance, two additional cylinders 122 and 124 and two additional rams 126 and 128 are employed. These can be mounted on the other one of the parallel base members 66 and the other one of the parallel rocker arms 20, if desired. As shown, the additional cylinders and rams are located closer to the pivot point 22 and are also smaller diameter. With the resulting shorter strokes for the rams 126 and 128 are the smaller diameters for the cylinders 122 and 124 and the rams 126 and 128, the output thereof can be substantially less than the output of the cylinders 12 and 14 and the rams 16 and 18. With this arrangement, it is possible to obtain precise and very high ratios of the materials moved by the two systems, in the order of 100 to 1 by way of example. Further, high viscosity materials and low viscosity ones can be handled by the same system. Also, when higher outputs are desired, all four of the cylinders can handle the same material. Of course, it will be readily understood that even more than two pair of the cylinders and rams can be employed if desired, such as if coloring is to be added to the first two materials, for example.

In this particular illustration, the outputs from the two pairs of cylinders are supplied through the outlet line 52 and on outlet line 130 to a mixing head indicated at 132. This mixing head can be of the type shown in my U.S. Pat. NO. 3,920,223, issued Nov. 18, 1975. Particularly for highly filled resins, the recirculation is preferably eliminated and ball valves are employed for the inlet ports. A dead-end shutoff is thereby obtained and large passages for the resins can be employed. After mixing within the mixing head, the materials can be supplied through two outlets 134 and 136 to points of use. With highly filled resins used in sheet-molding-compound lines, the mixed materials from the outlets 134 and 136 can be supplied to doctor blades used on the line.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. Apparatus for metering viscous material comprising means for establishing a source of material at positive pressure above atmospheric pressure, an outlet where the material is at a higher pressure, a first cylinder having a first ram reciprocable therein, first inlet means connecting said source of positive pressure material with said first cylinder, said first inlet means having a first ball check valve enabling flow of the material only toward said first cylinder, first outlet means connecting said first cylinder with said outlet, said first outlet means having a second ball check valve enabling flow of the material only away from said first cylinder, a second cylinder having a second ram reciprocable therein, second inlet means connecting said source of positive pressure material with said second cylinder, said second inlet means having a third ball check valve enabling flow of the material only toward said second cylinder, second outlet means connecting said second cylinder with said outlet, said second outlet means having a fourth ball check valve enabling flow of material only away from said second cylinder, back-pressure means through which material must flow for establishing back pressure of the material at said outlet, and means for reciprocating said first and second rams in said first and second cylinders.

2. Apparatus according to claim 1 characterized by said reciprocating means reciprocates said first and second at rams in opposite directions.

3. Apparatus for metering viscous material comprising means forming a source of the material at positive pressure above atmospheric pressure, an outlet where the material is at a higher pressure, a first cylinder, a first ram mounted for reciprocation in said first cylinder, said first ram comprising an enlarged head within said first cylinder with peripheral openings through which the material can pass from one side to the other, said ram also having a cylindrical portion extending from said enlarged head to a point outside an end of said first cylinder, a second cylinder, a second ram mounted for reciprocation in said second cylinder, said second ram having a second enlarged head within said second cylinder with peripheral openings through which the material can pass from one side to the other, said second ram also having a second cylindrical portion extending from said second enlarged head to a point outside an end of said second cylinder, means connecting said cylinders to said source of material, check valve means in said connecting means enabling flow of material only from said source to said cylinders, outlet means connecting said cylinders to said outlet, additional check valve means in said outlet means enabling flow of material only from said cylinders to said outlet, a rocker arm, said rocker arm being pivotally connected to said first ram, said rocker arm being pivotally connected to said second ram at a location spaced from said first ram, means pivotally supporting said rocker arm between said rams, and drive means for rocking said rocker arm about said pivot means to reciprocate said rams in opposite directions.

4. Apparatus according to claim 3 characterized by said drive means comprising a fluid-operated cylinder mechanically connected to an end of said rocker arm for oscillating same, and a second fluid-operated cylinder mechanically connected to the other end of said rocker arm for cooperating with said first fluid-operated cylinder to oscillate said rocker arm.

5. Apparatus according to claim 3 characterized further by a third cylinder, a third ram mounted for reciprocation in said third cylinder, said rocker arm being pivotally connected to said third ram between said pivot means and said first ram, a fourth cylinder, a fourth ram mounted for reciprocation in said fourth cylinder, said rocker arm being pivotally connected to said fourth ram between said pivot means and said second ram, means forming a separate source of material at positive pressure above atmospheric pressure for said third cylinder and said fourth cylinder, a second outlet for said third cylinder and said fourth cylinder, and mixer means connected to said outlet for said first and second cylinders and to the outlet for said third and fourth cylinders for receiving and mixing the two materials from the two sources.

6. Apparatus for moving and metering first and second different viscous materials from first and second sources of materials at positive pressures above atmospheric pressure to first and second outlets where the materials are at higher pressures, said apparatus comprising a first cylinder having a first ram reciprocable therein, first inlet means connecting said first source of positive pressure material with said first cylinder, said first inlet means having first check valve means enabling flow of the first material only toward said first cylinder, first outlet means connecting said first cylinder with said first outlet, said first outlet means having second check valve means enabling flow of the first material only away from said first cylinder, a second cylinder having a second ram reciprocable therein, second inlet means connecting said first source of positive pressure material with said second cylinder, said second inlet means having third check valve means enabling flow of the first material only toward said second cylinder, second outlet means connecting said second cylinder with said first outlet, said second outlet means having fourth check valve means enabling flow of the first material only away from said second cylinder, a third cylinder having a third ram reciprocable therein, third inlet means connecting said second source of positive pressure material with said third cylinder, said third inlet means having fifth check valve means enabling flow of the second material only toward said third cylinder, third outlet means connecting said third cylinder with said second outlet, said third outlet means having sixth check valve means enabling flow of the second material only away from said third cylinder, a fourth cylinder having a fourth ram reciprocable therein, fourth inlet means connecting said second source of positive pressure material with said fourth cylinder, said fourth inlet means having seventh check valve means enabling flow of the second material only toward said fourth cylinder, fourth outlet means connecting said fourth cylinder with said second outlet, said fourth outlet means having eighth check valve means enabling flow of the second material only away from said fourth cylinder, and means for reciprocating said first and second rams in opposite directions and for reciprocating said third and fourth rams in opposite directions.

7. Apparatus according to claim 6 characterized further by said inlet means communicating with said cylinders at the blind ends thereof and said outlet means communicating with said cylinders at the other ends thereof.

8. Apparatus according to claim 6 characterized by said rams having enlarged ends within said cylinders with said enlarged ends having peripheral openings therein past which material can flow in said cylinders when said rams are reciprocated.

9. Apparatus according to claim 6 characterized by said last-named means comprising a rocker arm, pivot means pivotally supporting said rocker arm, means pivotally connecting said first ram to said rocker arm on one side of said rocker arm pivot means, means pivotally connecting said second ram to said rocker arm on the other side of said rocker arm pivot means, means pivotally connecting said third ram to said rocker arm between said first ram pivot means and said rocker arm pivot means, means pivotally connecting said fourth ram to said rocker arm between said second ram pivot means and said rocker arm pivot means, and drive means connected to said rocker arm for rocking said rocker arm about the rocker arm pivot means, first in one direction and, subsequently, in the opposite direction to reciprocate said rams in said cylinders.

10. Apparatus according to claim 9 characterized by said pivot means for said first, second, third, and fourth rams being selectively infinitely movable along said rocker arm whereby the strokes of the rams can be changed in infinite degrees to change the metered quantities of the first and second materials and the ratio of them.

11. Apparatus for metering and mixing first and second different viscous materials, said apparatus comprising means for establishing a first source of the first viscous material at a positive pressure above atmospheric pressure, a first supply line communicating with said first source means, means for establishing a second source of the second viscous material at a positive pressure above atmospheric pressure, a second supply line communicating with said second source means, means forming a first outlet where the first material is at a higher pressure than at the first source, means forming a second outlet where the second material is at a higher pressure than at the second source, a first cylinder having a first ram reciprocable therein, said first ram having a cylindrical portion, the diameter of which exceeds one-half the diameter of said first cylinder, said first ram having an enlarged head within said first cylinder with peripheral openings around said cylindrical portion through which the first material can pass from one side to the other, first inlet means connecting said first supply line with the blind end of said first cylinder, said first inlet means having a first ball check valve enabling flow of the first material only toward said first cylinder, first outlet means connecting the other end of said first cylinder with said first outlet, said first outlet means having a second ball check valve enabling flow of the first material only away from said first cylinder, a second cylinder having a second ram reciprocable therein, said second ram having a cylindrical portion, the diameter of which exceeds one-half the diameter of the second cylinder, said second ram having an enlarged head within said second cylinder with peripheral openings around the cylindrical portion of said second ram through which the first material can pass from one side to the other, second inlet means connecting said first supply line with the blind end of said second cylinder, said second inlet means also communicating with said first inlet means, said second inlet means having a third ball check valve enabling flow of the first material only toward said second cylinder, second outlet means connecting the other end of said second cylinder with said first outlet, said second outlet means also communicating with said first outlet means, said second outlet means having a fourth ball check valve enabling flow of the first material only away from said second cylinder, a third cylinder having a third ram reciprocable therein, third inlet means connecting said second supply line with the blind end of said third cylinder, said third inlet means having a fifth ball check valve enabling flow of the second material only toward said third cylinder, third outlet means connecting the other end of said third cylinder with said second outlet, said third outlet means having a sixth ball check valve enabling flow of the second material only away from said third cylinder, a fourth cylinder having a fourth ram reciprocable therein, fourth inlet means connecting said second supply line with the blind end of said fourth cylinder, said fourth inlet means also communicating with said third inlet means, said fourth inlet means having a seventh ball check valve enabling flow of the second material only toward said fourth cylinder, fourth outlet means connecting the other end of said fourth cylinder with said second outlet, said fourth outlet means also communicating with said third outlet means, said fourth outlet means having an eighth ball check valve enabling flow of the second material only away from said fourth cylinder, means communicating with said first outlet for establishing back pressure of the first material at said first outlet, means communicating with said second outlet for establishing back pressure of the second material at said second outlet, a mixing head connected with said first outlet and said second outlet for mixing metered quantities of said first material and said second material, a rocker arm, pivot means pivotally supporting said rocker arm, means pivotally connecting said first ram to said rocker arm on one side of said rocker arm pivot means, means pivotally connecting said second ram to said rocker arm on the other side of said rocker arm pivot means, means pivotally connecting said third ram to said rocker arm between said first ram pivot means and said rocker arm pivot means, means pivotally connecting said fourth ram to said rocker arm between said second ram pivot means and said rocker arm pivot means, and drive means connected to said rocker arm for rocking said rocker arm about the rocker arm pivot means, first in one direction, and, subsequently, in the opposite direction to reciprocate said rams in said cylinders, said pivot means for said first, second, third, and fourth rams being selectively movable along said rocker arm whereby the strokes of the rams can be changed to change the metered quantities of the first and second materials and the ratio of them.

12. Apparatus for metering viscous material comprising means for establishing a source of material at positive pressure above atmospheric pressure, an outlet where the material is at a higher pressure, a first cylinder having a first ram reciprocable therein, first inlet means connecting said source of positive pressure material with said first cylinder, said first inlet means having first check valve means enabling flow of the material only toward said first cylinder, first outlet means connecting said first cylinder with said outlet, said first outlet means having second check valve means enabling flow of the material only away from said first cylinder, a second cylinder having a second ram reciprocable therein, each of said rams having an enlarged head within the respective cylinder with peripheral openings through which the material can pass from one side to the other, second inlet means connecting said source of positive pressure material with said second cylinder, said second inlet means having third check valve means enabling flow of the material only toward said second cylinder, second outlet means connecting said second cylinder with said outlet, said second outlet means having fourth check valve means enabling flow of material only away from said second cylinder, back-pressure means through which material must flow for establishing back pressure of the material at said outlet, and means for reciprocating said first and second rams in said first and second cylinders.

13. Apparatus according to claim 12 characterized by each of said rams having a cylindrical portion, the diameter of which exceeds one half the diameter of the respective cylinder, said openings being around said cylindrical portion.

14. Apparatus for metering viscous material comprising means for establishing a source of material at positive pressure above atmospheric pressure, an outlet where the material is at a higher pressure, a first cylinder having a first ram reciprocable therein, first inlet means connecting said source of positive pressure material with said first cylinder, said first inlet means having first check valve means enabling flow of the material only toward said first cylinder, first outlet means connecting said first cylinder with said outlet, said first outlet means having second check valve means enabling flow of the material only away from said first cylinder, a second cylinder having a second ram reciprocable therein, second inlet means connecting said source of positive pressure material with said second cylinder, said second inlet means having third check valve means enabling flow of the material only toward said second cylinder, second outlet means connecting said second cylinder with said outlet, said second outlet means having fourth check valve means enabling flow of material only away from said second cylinder, said inlet means communicating with said cylinders at the blind ends thereof and said outlet means communicating with said cylinders at the other ends thereof, back-pressure means through which material must flow for establishing back pressure of the material at said outlet, and means for reciprocating said first and second rams in said first and second cylinders.

15. Apparatus according to claim 14 characterized by said rams having enlarged ends within said cylinders with said enlarged ends having peripheral openings therein past which material can flow in said cylinders when said rams are reciprocated.

* * * * *

UNITED STATES PATENT OFFICE

CERTIFICATE OF CORRECTION

PATENT NO. : 4,118,799

DATED : October 3, 1978

INVENTOR(S) : Wallace F. Krueger

It is certified that error appears in the above-identified patent and that said Letters Patent are hereby corrected as shown below:

Column 1, line 15, after "maintainence-free" insert a --comma--
Column 4, line 23, for "themore" substitute -- the more --.
Column 5, line 8, for "are" substitute -- and --.
Column 5, line 24, for "on" substitute -- an --.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*